US006092340A

United States Patent [19]

Simmons

[11] Patent Number: 6,092,340

[45] Date of Patent: Jul. 25, 2000

[54] STRUCTURAL FRAMING SYSTEM AND METHOD OF ASSEMBLY

[76] Inventor: David G. Simmons, 9417 S. Broadway, St. Louis, Mo. 63125

[21] Appl. No.: 09/215,363

[22] Filed: Dec. 18, 1998

Related U.S. Application Data

[60] Provisional application No. 60/074,950, Feb. 17, 1998.

[51] Int. Cl.[7] ..... E04B 1/19

[52] U.S. Cl. ..... 52/92.1; 52/92.2; 52/481.1; 52/94; 52/650.1

[58] Field of Search ..... 52/92.1, 92.2, 52/94, 95, 633, 650.1, 653.2, 481.1, 731.5, 730.1

[56] References Cited

U.S. PATENT DOCUMENTS

| | | | |
|---|---|---|---|
| 2,067,403 | 1/1937 | Lea | 52/92.1 X |
| 3,034,609 | 5/1962 | Young | 52/481.1 X |
| 3,152,672 | 10/1964 | Oppenhuizen et al. | 52/731.5 X |
| 3,310,926 | 3/1967 | Brandreth et al. | 52/481.1 |
| 3,440,785 | 4/1969 | Denny et al. | 52/481.1 X |
| 3,556,888 | 1/1971 | Goldsworthy . | |
| 3,568,388 | 3/1971 | Flachbarth et al. | 52/588.1 |
| 3,668,828 | 6/1972 | Nicholas et al. | 52/92.1 |
| 3,966,533 | 6/1976 | Goldsworthy et al. . | |
| 4,179,857 | 12/1979 | Danford | 52/94 X |
| 4,435,940 | 3/1984 | Davenport et al. | 52/92.1 X |
| 4,557,091 | 12/1985 | Auer . | |
| 4,612,744 | 9/1986 | Shamash . | |
| 4,837,999 | 6/1989 | Stayner . | |
| 4,995,213 | 2/1991 | Bezubic . | |
| 5,197,253 | 3/1993 | Johnson . | |
| 5,390,466 | 2/1995 | Johnson et al. . | |
| 5,392,580 | 2/1995 | Baumann . | |
| 5,448,869 | 9/1995 | Unruh et al. . | |
| 5,596,860 | 1/1997 | Hacker | 52/92.1 X |
| 5,937,607 | 8/1999 | Li | 52/481.1 X |

FOREIGN PATENT DOCUMENTS

| | | | |
|---|---|---|---|
| 420033 | 1/1947 | Italy | 52/92.1 |

*Primary Examiner*—Carl D. Friedman
*Assistant Examiner*—Phi Dieu Tran A
*Attorney, Agent, or Firm*—Kevin L. Klug

[57] ABSTRACT

A structural framing system having a plurality of elongated members which are capable of assembly with a minimum number of specialty tools and with minimal use of specialty labor and which provides superior strength. The structural framing system of the current invention with the unique cross sectional shape of its elongated members lends itself to manufacture from pultruded fiberglass material in a preferred embodiment. The present invention when manufactured in its preferred embodiment provides superior corrosion, fire and weather resistance while also providing a structural framing system which is light enough to be easily transportable.

18 Claims, 23 Drawing Sheets

STRUCTURAL FRAMING SYSTEM AND METHOD OF ASSEMBLY

This application claims priority of Provisional Patent Application #60/074,950, filed Feb. 17, 1998.

BACKGROUND OF THE INVENTION

The present invention relates in general to structural framing systems and pertains, more particularly, to a pultruded fiberglass, lightweight, and easily assembled frame for a house, shed or storage area which also provides superior strength, especially for climates which expose the structure to high winds.

Pultrusion allows fiberglass structural components to be manufactured in lengths which allow their superior strength characteristics to be utilized in the form of structural building components. The pultrusion process, although not the same, can be likened to an ordinary extrusion process in which fiberglass fibers are interlaced with a resin which is cured by the application of heat. The process is thoroughly described in U.S. Pat. No. 3,556,888 Pultrusion Machine and Method, issued to Goldsworthy on Jan. 19, 1971. It is important to note that the art of the present invention is not drawn to the pultrusion process itself, but to the unique shape, form, interconnection, application and method of use of the structural products described herein which are especially adapted to formation by pultrusion methods.

With conventional structural framing systems, a tradeoff often exists between the weight of the structural materials, the ease of assembly of the structural materials, the skill level of the construction personnel required for assembly, the insulation properties of the structural materials, the material weathering and corrosion resistance characteristics, the material fire resistance, and the strength of the final structural assembly. For example, structural materials manufactured of steel generally provide a strong and fire resistant structural assembly but present weight concerns which inhibit material transporting, are difficult to assemble, are corrosion and weathering sensitive, are poor thermal insulators and often require many skilled construction personnel for assembly. Wood structural framing systems generally provide low weight, ease of assembly, and good insulation properties, but are often moderate to poor in their weathering, strength, and fire resistant characteristics and often require specialty assembly tools and skilled construction personnel. The art of the present invention provides for excellent material weight properties and ease of assembly with only a few ordinary tools and non-skilled construction personnel. The art of the present invention further provides for exceptional insulation properties, outstanding weathering characteristics, good fire resistance, and a final structural strength which is commensurate with many steel structures. All of the aforesaid advantages are available when the structural components of the present art, with the unique shapes, order of assembly, and means of connection described herein, are formed via the process of fiberglass pultrusion in a preferred embodiment.

Accordingly, it is an object of the present invention to provide a structural framing system and method of assembly which is easily assembled, light in weight, energy efficient, fire resistant, weather and corrosion resistant, and structurally strong.

Another object of the present invention is to provide a structural framing system and method of assembly which provides all of the aforementioned characteristics in a cost effective manner.

A further object of the present invention is to provide a structural framing system and method of assembly which is capable of being assembled with a limited number of ordinary tools and non-skilled construction personnel.

A still further object of the present invention is to provide a structural framing system having components which are readily manufactured from pultruded fiberglass.

SUMMARY OF THE INVENTION

To accomplish the foregoing and other objects of this invention, there is provided in a preferred embodiment a structural framing system having a plurality of pultruded fiberglass sill plates arranged in a substantially rectangular form; said rectangular form having an internal and external portion. There is further provided, four or more pultruded fiberglass outside corner posts, which are mounted substantially perpendicular to and attached to said sill plates, a plurality of pultruded fiberglass outside studs which are also mounted substantially perpendicular to the sill plates, one or more pultruded fiberglass eave headers (with inside attachment clips) across and on the top of the plurality of outside studs, one or more pultruded fiberglass gable headers (with inside attachment clips), again across and on the top of the plurality of outside studs but located in a substantially 90° spatial relation with said eave headers, a ridge beam attached between the two opposing sides of the substantially rectangular form containing the gable headers, one or more column studs for support of said ridge beam, a plurality of pultruded rafters placed and attached between the ridge beam and the eave headers, a plurality of pultruded fiberglass inside studs which mate and attach to the outside studs within the substantially rectangular form, and a plurality of pultruded fiberglass window and door channels for those openings where a window or door would be desired. An alternative embodiment would replace the pultruded rafters and ridge beam with a plurality of trusses formed in a conventional manner, preferably from pultruded fiberglass material.

Often the aforementioned sill plates are placed and secured onto a concrete footing. In a preferred embodiment, each sill plate is comprised of a pultruded and substantially "U" shaped channel cross section having an extension plate extending from the bottommost portion of the "U" on the internal side. Each extension plate is perpendicular to the walls of the "U". An alternative embodiment of the sill plate would be comprised of the substantially "U" shaped channel only and would be used primarily for conventional foundations.

The aforesaid outside corner posts are substantially rectangular and hollow in cross section with extension ears on each portion of the cross section which abuts the external portion of the substantially rectangular sill plate form. In a preferred embodiment, the outside corner post has a concave cross section portion which is located on a corner nearest the internal portion of the rectangular cross section and substantially opposite the corner of the portion of the cross section which is located near the external portion of the rectangular sill plate form. In a preferred embodiment, both the extension ears and the concave portion run the entire length of the outside corner post.

The aforementioned outside studs are capable of being cut to various lengths. In a preferred embodiment, each outside stud is pultruded as a one piece substantially rectangular and hollow cross section on a plate extending beyond the width of the rectangular cross section. An alternative description would describe the outside stud as a substantially rectangular and hollow cross section having coplaner and substantially flat ears on that portion of the outside stud which is located near the external portion of the substantially rectangular sill plate form. Operating in conjunction with the outside studs are a plurality of inside studs. Each inside stud has the substantially same cross section as the outside stud with a lengthwise slot located between said flat ears and through a wall of said rectangular cross section. This slot allows for convenient runs and placement of utility wires, pipes, etc within the hollow portion of the inside stud. The inside stud is placed such that it mates and attaches lengthwise with the outside stud and has its flat ears opposite and away from said outside stud and on the internal side of the substantially rectangular sill plate form.

Each eave and gable header is mounted parallel with and opposite the sill plate on a topmost portion of the outside studs. Securing of each eave or gable header is achieved via the use of an inside attachment clip which holds the header to the outside and inside stud combination. The combination of the inside clip and the header forms a header channel for utility runs. A channel cover, typically vinyl, is used for enclosure and covering of said channel if no other covering material such as drywall is placed thereover.

Upon the installation of the eave headers and gable headers the ridge beam is placed and attached between the two opposing sides of the substantially rectangular form containing the gable headers. The ridge beam may take one of two forms. In an alternative embodiment, the ridge beam comprises two fastener joined pultruded sections, between which is sandwiched a flitch plate, preferably of steel, to maintain the necessary stiffness for a given span. In a preferred embodiment, the ridge beam is pultruded as one piece. The ridge beam has a ridge beam cover, preferably of vinyl, which may be placed onto its interior exposed portion if not covered by a material such as drywall or other wallboard.

The ridge beam is supported by column studs or steel columns at each end and at any other point where support is required. In an alternative embodiment, steel columns are used to support the ends of the ridge beam. In a preferred embodiment, column studs are used to support said ridge beam. Each column stud comprises a cross section substantially similar to the outside studs except that the wall thickness of said substantially rectangular cross section is substantially thicker than the outside stud. When installed, the column stud would replace and function as a typical outside stud.

Upon installation of the ridge beam, rafters are placed and attached between the ridge beam and the eave headers. In a preferred embodiment, the rafters are pultruded and placed and separated by 24 inches, center to center, but may be separated by any width required by the application. Each rafter has an attaching rafter clip which is able to sandwich and hold roofing panels and/or insulation material between the clip and the main body section of the rafter.

Onto and parallel with each gable header is placed and fastened an end rafter. A rafter clip is placed onto each end rafter in order to sandwich and hold roofing panels and/or insulation material between the clip and the main body section of the rafter.

An alternative embodiment places trusses, in lieu of the rafter and ridge beam combination, across the eave headers and secures each truss with a truss clip. Each truss is formed in a conventional manner, preferably of pultruded fiberglass members of substantially rectangular cross section with a hollow core.

In order to provide structural mounting for windows and doors, a plurality of substantially "C" shaped window and door channels are mounted vertically and/or horizontally where necessary. These channels function much as conventional framing lumber with the exception that they offer all of the advantages of pultruded fiberglass.

Although the preferred embodiments of the structural framing system components described herein would utilize a pultruded fiberglass material, the structural framing system of the present art may be manufactured of a variety of materials, including but not limited to wood, plastic, steel, aluminum, or other composite materials. The preferred and alternative embodiments described herein may also be manufactured in different sizes and colors.

All of the aforementioned structural components are fastened together in their respective locations with the use of conventional fasteners such as sheet metal screws, machine screws, nuts, and concrete anchor bolts, but may also be fastened using other types fasteners such as pins, studs or clamps or with the use of specialty adhesives. In a preferred embodiment, the fasteners are comprised of #10 sheet metal screws except for fastening of the column studs, ridge beam, flitch plate and associated beam, end rafters, and roof rafters which use ¼-20 machine screws for fastening.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 32:
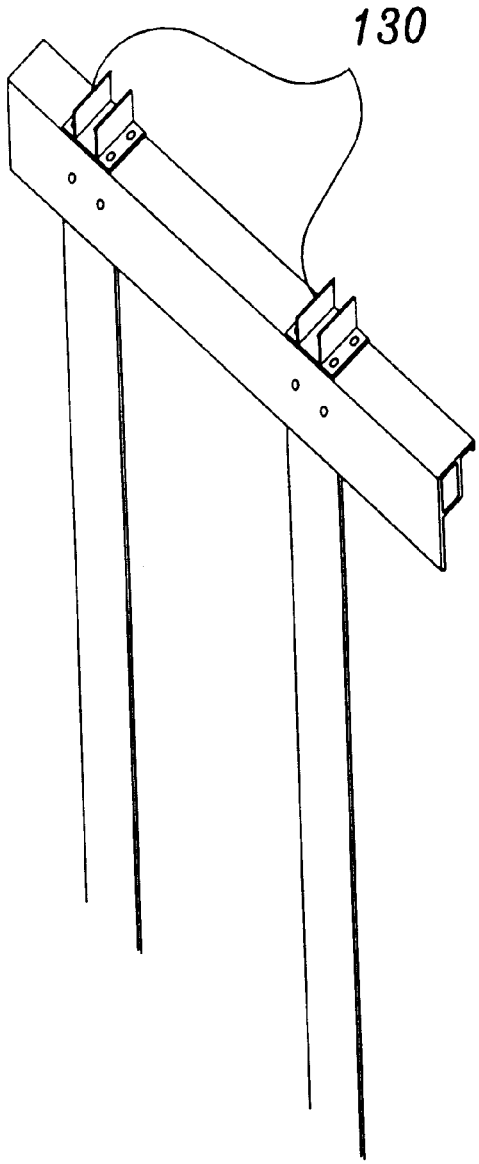
FIG. 32 is a perspective view of an eave header supported by outside studs and having a pair of truss clips mounted thereon.
Figure 33:
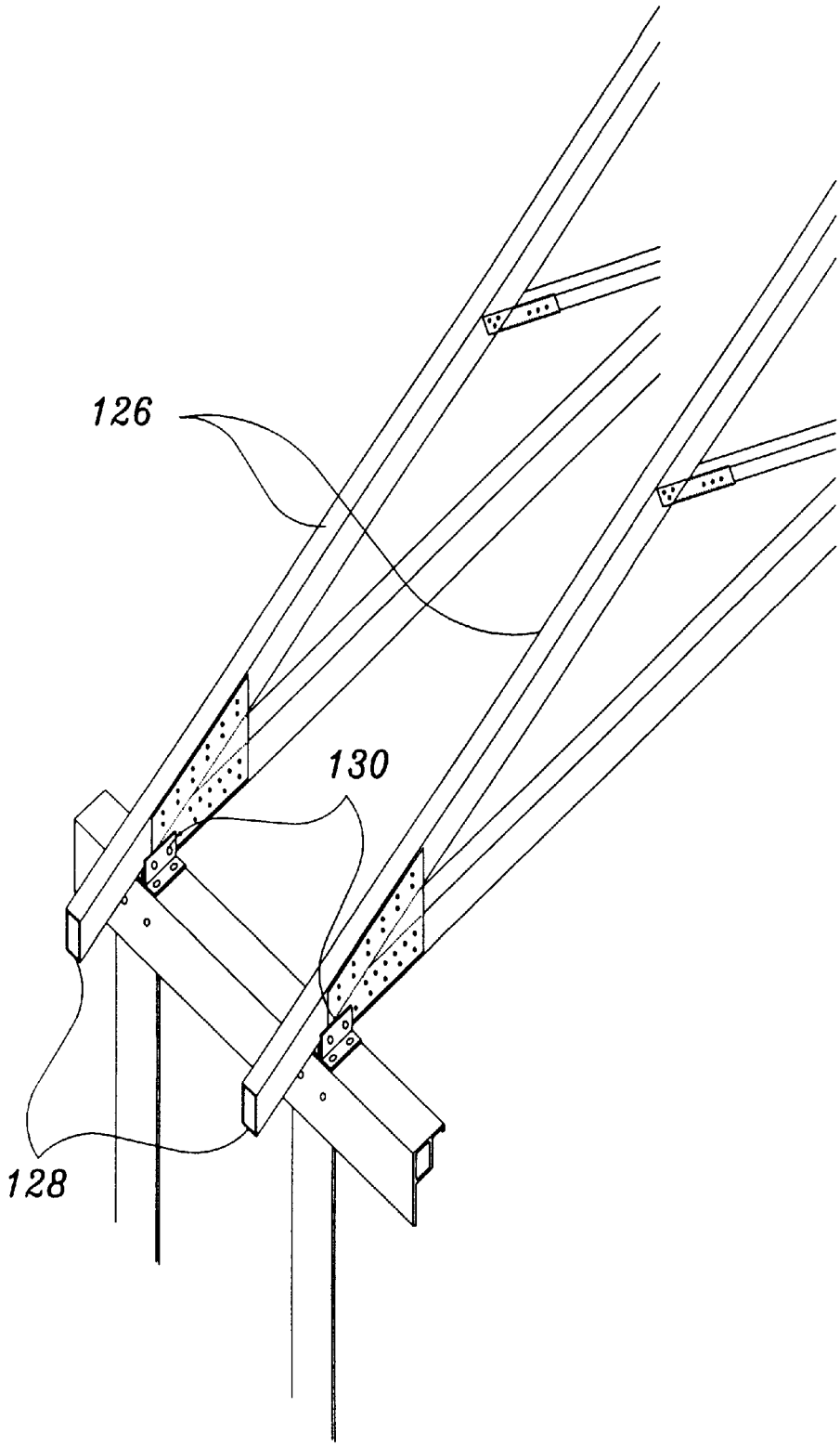
FIG. 33 is a perspective view of one end of a pair of trusses mounted onto the assembly of FIG. 32.

Referring now to the drawings there is shown a preferred embodiment in FIGS. 1, 6–16, 18–25, & 27–31 of the structural framing system and the individual components of the invention, with FIGS. 6, 7, 15, 32 & 33 having some alternative components. Alternative embodiments of the structural column stud, sill plate and ridge beam are shown in FIGS. 2–5, 17, 26 respectively. An alternative embodiment showing the use of trusses is shown in FIG. 32. All of the structural components described hereafter, except for those noted, are elongated members whose cross section is substantially constant throughout the members elongation, thereby requiring description of the cross section only.

The drawings show the structural framing system 10 affixed to a concrete footing 12. Preferred embodiments would not require a concrete footing 12, although one may be used for added structural integrity. The drawings also show a plurality of sill plates 14 arranged in a substantially rectangular form 20. The substantially rectangular form 20 defines an internal portion 22 and an external portion 24. In a preferred embodiment, the sill plate 14 is manufactured of pultruded fiberglass with a cross section of "U" shaped channel 18 and an integral extension plate 16 extending from the lowest portion of the "U" shape 18. The integral extension plate 16 provides additional support for said sill plate 14,especially when a concrete footing 12 is not used. Alternative embodiments of the sill plate 14 do not contain the extension plate 16 and are primarily for applications which have a concrete footing 12.

Into the sill plates 14 "U" shaped channel 18, at the corners of the substantially rectangular form 20, is attached and mounted four or more outside corner posts 26 which are positioned substantially perpendicular to and attached to said sill plates 14. In a preferred embodiment, the outside corner posts 26 are formed from pultruded fiberglass with a substantially rectangular and hollow cross section 27 with extension ears 28 on each portion of the cross section which abuts the external portion 24 of the substantially rectangular 20 sill plate 14 form. A preferred embodiment of the outside corner post also has a concave cross section portion 30 which is located on a corner nearest the internal portion 22 of the rectangular cross section 27 and substantially opposite the corner of the portion of the cross section 27 which is located near the external portion 24 of the rectangular sill plate form 20. In a preferred embodiment, both the extension ears 28 and the concave portion 30 run the entire length of the outside corner post 26.

Further attached and mounted onto the sill plates 14 is a plurality of outside studs 32 which are also placed within and 3substantially perpendicular to the sill plates 14 nearest the external portion 24. In a preferred embodiment, the outside studs 32 are formed from pultruded fiberglass and separated by 24 inches, center to center, but may be separated by any width required by the application. The aforementioned outside studs 32 and the outside corner posts 26 are capable of being cut to various lengths in order to accommodate the height and contour of the structure 10 desired. In a preferred embodiment, each outside stud 32 is formed as a one piece substantially rectangular and hollow cross section 34 having coplaner and substantially flat ears 36 on that portion of the outside stud which is located near the external portion 24 of the substantially rectangular sill plate form 20 when placed. Operating in conjunction with the outside studs 32 are a plurality of inside studs 38. Each inside stud 38 has substantially the same cross section as the outside stud 32 except that the inside stud 38 has a lengthwise slot 40 located between said flat ears 36 and through a wall of said rectangular cross section 34. Hereafter for claim purposes, the cross sectional description of the inside stud 38 shall be described as a second rectangular and hollow cross section in combination with a second coplaner and substantially flat ear. The slot 40 in the inside stud 38 allows for convenient runs and placement of utility wires and pipes within the hollow portion of the inside stud 38. The inside stud 38 is placed, within the sill plate 14 and attached, and assembled such that it mates lengthwise with the outside stud and has its flat ears opposite and away from 1022 of the su 32 on the internal portion 22 of the substantially rectangular sill plate form 20. The inside stud 38 is also attached and mounted in a position which is substantially perpendicular to the sill plates 14. Again, in a preferred embodiment, each inside stud 32 is formed as a single stud from pultruded fiberglass.

Upon placement of the outside studs 32, outside corner posts 26, and the inside studs 38, the structural framing system 10 is capable of accepting an attachment of two or more eave headers 42 onto those portions of said studs 38, 32 and posts 26 opposite the sill plate 14. The eave header 42 cross section is formed from a first eave plate 44 and a second eave plate 46 which are positioned between 90 and 135 degrees relative to each other. Within the portion having said angle between 90 and 135 degrees is placed an eave plate support section 48. The eave plate support section 48 forms a support web between the aforesaid plates 44, 46 and thereby reinforces the strength of the header 42. Although the support section 48 may take the form of any shape which helps to support the aforesaid plates 44, 46, in a preferred embodiment, the section 48 forms a substantially right angle. Again, in a preferred embodiment, each eave header 42 is formed as a single header from pultruded fiberglass. Furthermore, in a preferred embodiment, the eave headers 42 are typically used in pairs and placed on two opposing sides of the substantially rectangular form 20 in order to form the eave base for the structural framing system 10.

Securing of each eave header 42 is achieved via the use of an inside attachment clip 54 which holds the header to the outside 32 and inside 38 stud combination via attachment to the eave plate support section 48. The combination of the inside clip 54 and the header 42 forms an eave header channel 50 for utility runs. A channel cover, typically vinyl, is used for enclosure and covering of said channel 50.

The inside attachment clip 54 cross section is typically formed from a clip "U" shaped channel 56 having an attachment lip 58 and a contacting ear 60 formed integrally with said channel 56. The attachment lip 58 extends above the open end of the "U" shaped channel 56 and is generally parallel with and in-line with a leg of the topmost portion of the "U" of the "U" shaped channel 56. In a preferred embodiment, affixation of the inside attachment clip 54 to the eave header 42 is achieved via a fastener 122 which is placed through the attachment lip 58 and into the eave plate support section 48. The fastener 122 is typically a screw but may also be a pin, clamp, bolt or even an adhesive.

The contacting ear 60 is generally parallel with a leg of the "U", opposite the attachment lip 58, of the "U" shaped channel 56 but extends below the base of the "U". In operation, the contacting ear 60 abuts the inside stud 38 and allows the eave header 42/inside attachment clip 54 combination to affix to the inside stud 38/outside stud 32 combination when the aforesaid fastener 122 is secured.

For the gable ends of the structural framing system 10, two or more gable headers 62 are placed atop the inside stud 38/outside stud 32 combination. In a preferred embodiment, the gable headers 62 are placed in a generally 90 degree horizontal relationship with the eave headers 42. The gable headers 62 share a somewhat similar geometric cross section with the eave header 42. The gable header 62 is comprised of a first gable plate 64, a second gable plate 66, and a gable plate support section 68. The gable header 62 cross section is formed from a first gable plate 64 and a second gable plate 66 which are positioned approximately 90 degrees relative to each other. Within the portion having said angle is placed a gable plate support section 68. The gable plate support section 68 also forms a support web between the aforesaid plates 64, 66 and thereby reinforces the strength of the header 62. Although the support section 68 may take the form of any shape which helps to support the aforesaid plates 64, 66, in a preferred embodiment, the section 68 forms a substantially right angle. Again, in a preferred embodiment, each gable header 62 is formed as a single header from pultruded fiberglass. Furthermore, in a preferred embodiment, the gable headers 62 are typically used in pairs and placed on two opposing sides of the substantially rectangular form 20 in order to form the gable base for the structural framing system 10.

As with the eave headers 42, securing of each gable header 62 is achieved via the use of an inside attachment clip 54 which holds the header to the outside 32 and inside 38 stud combination via attachment to the gable plate support section 68. The combination of the inside clip 54 and the header 62 forms a gable header channel 70 for utility runs. A channel cover, typically vinyl, is used for enclosure and covering of said channel 70 if not altready covered by drywall or other wallboard type material.

Figure 1:
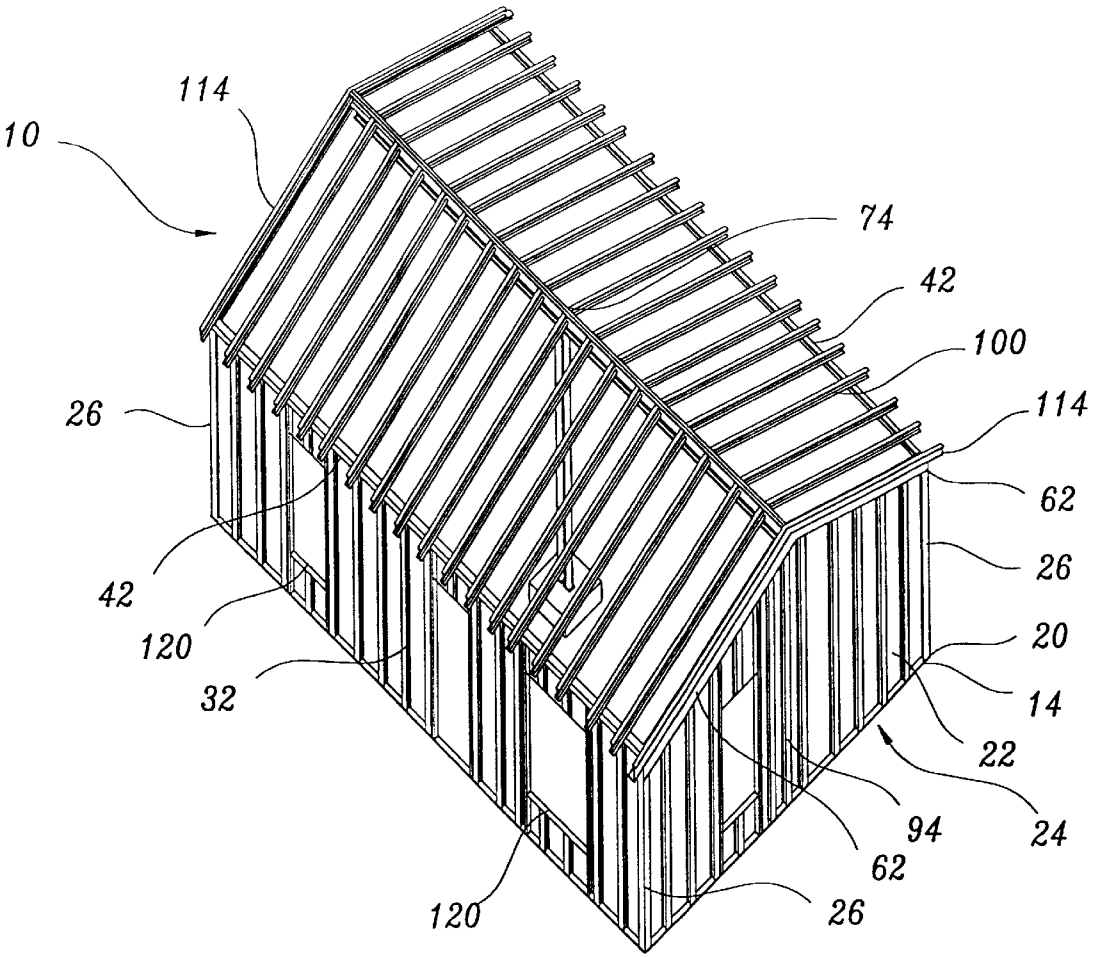
FIG. 1 is a perspective view of a preferred embodiment of the structural framing system.
Figure 3:
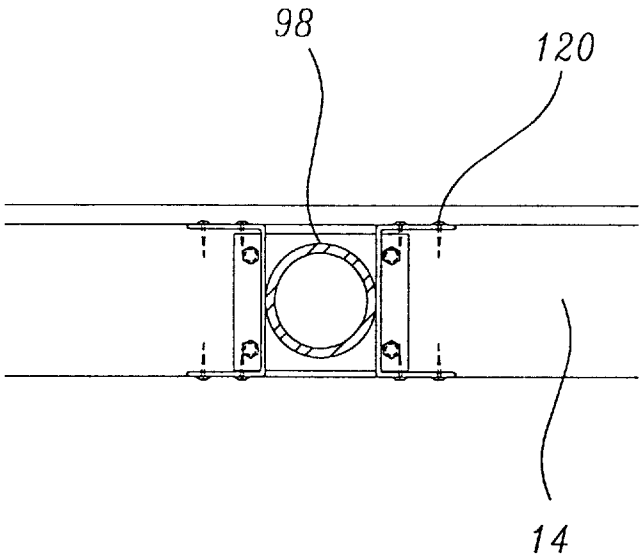
FIG. 3 is a top plan view of the structural column of FIG. 2.
Figure 2:
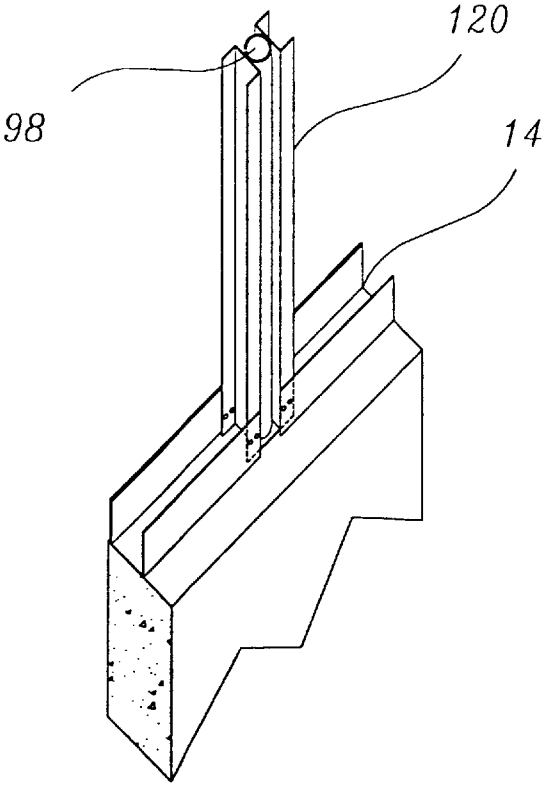
FIG. 2 is a perspective view of a structural inside column used for gable end support in an alternative embodiment.
Figure 4:
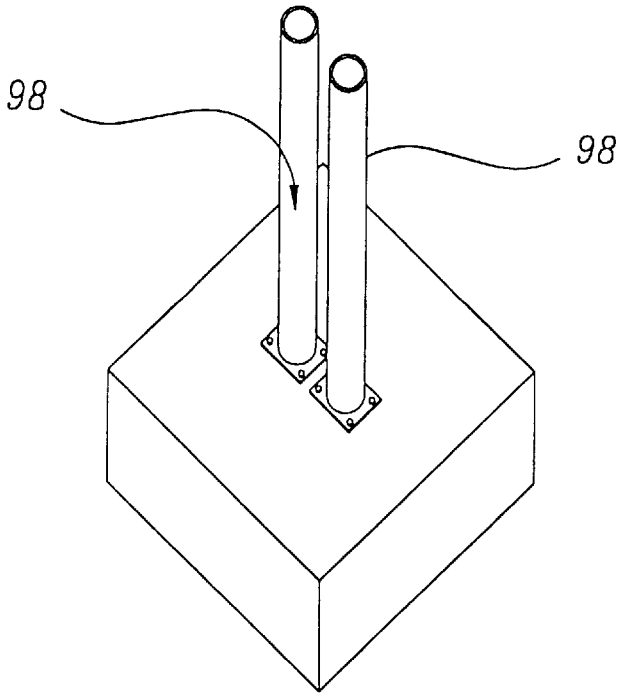
FIG. 4 is a perspective view of structural columns used for ridge beam support internal to the structural framing system in an alternative embodiment.
Figure 5:
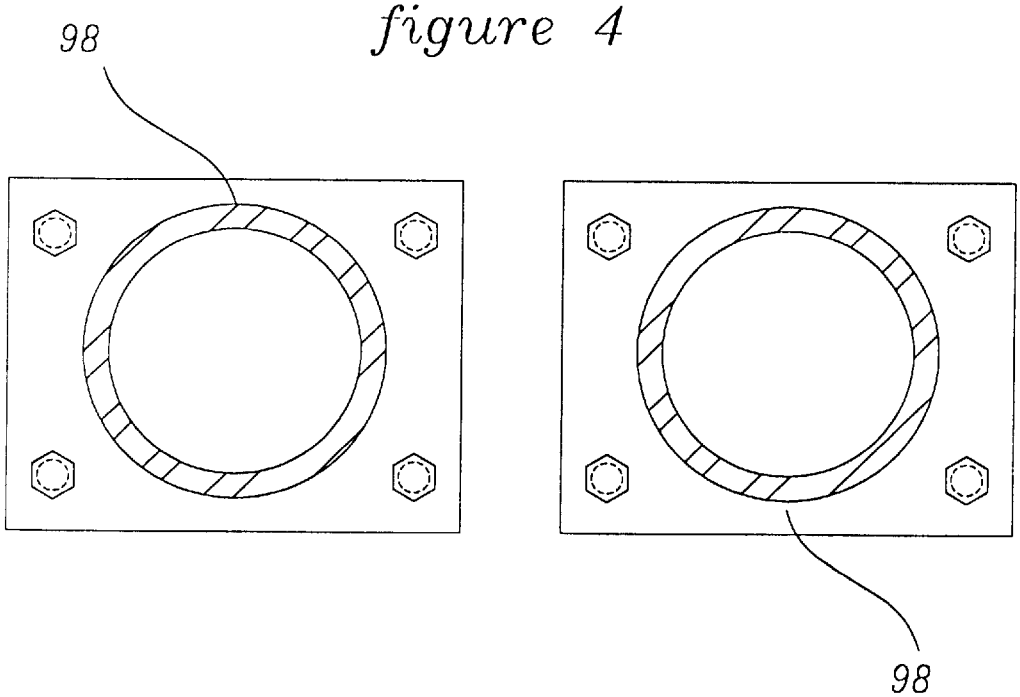
FIG. 5 is a top plan view of the structural columns of FIG. 4.
Figure 6:
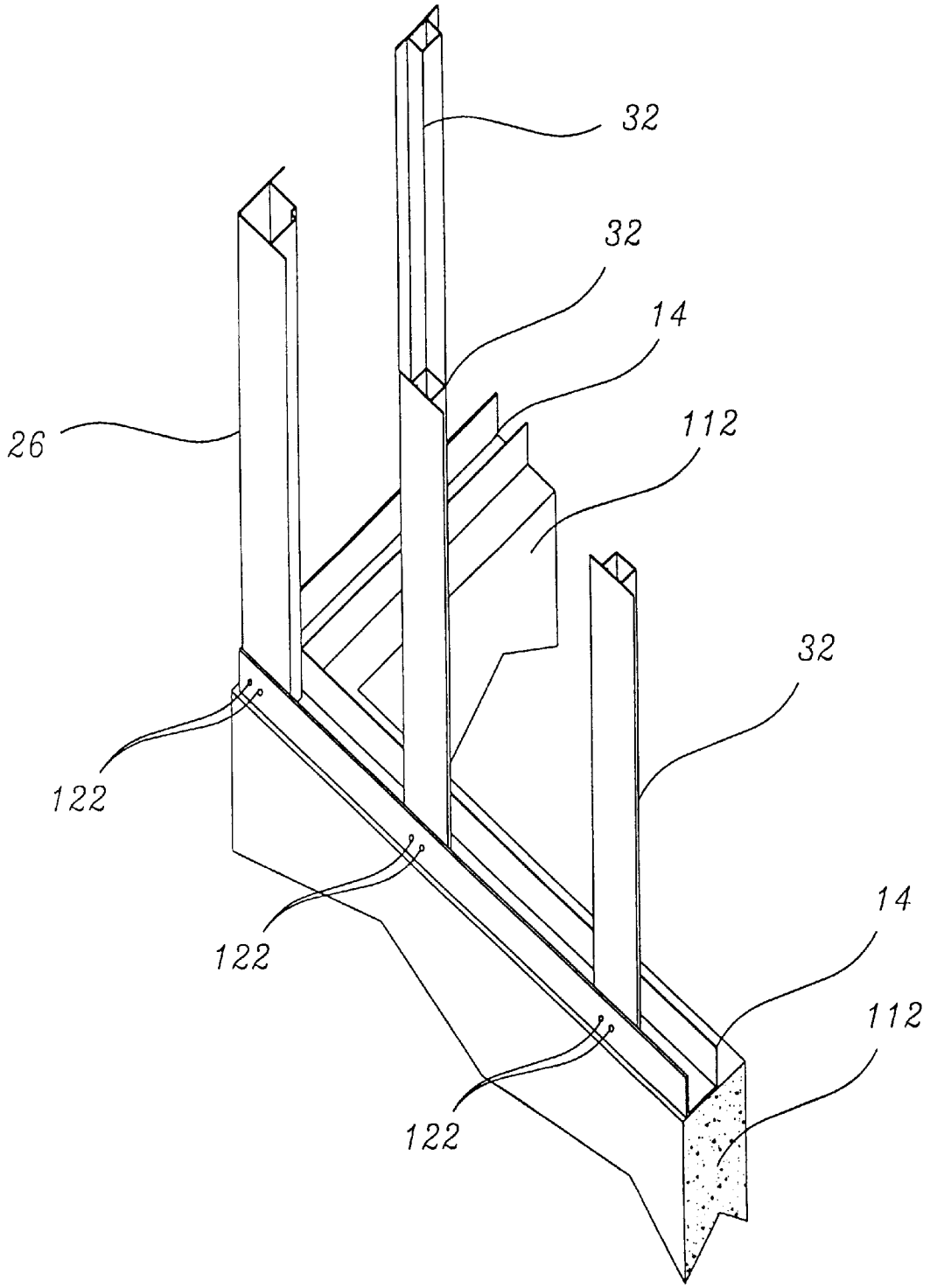
FIG. 6 is a perspective view of an outside corner post and outside studs mounted within alternative embodiment sill plates.
Figure 8:
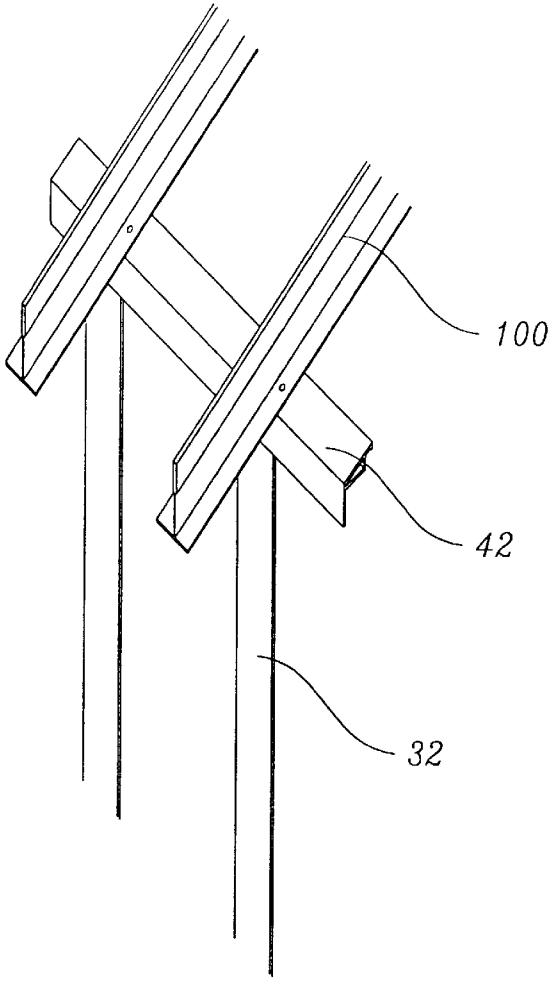
FIG. 8 is a perspective view of the roof rafters, eave plate, and outside studs assembled in a preferred embodiment.
Figure 7:
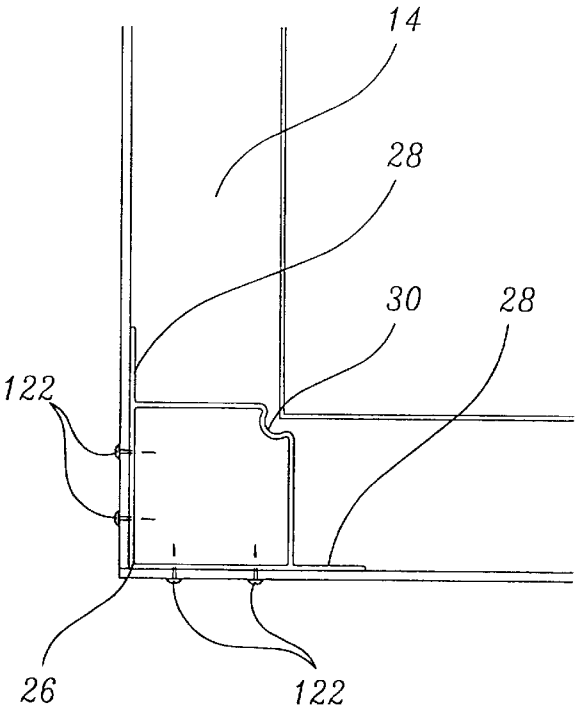
FIG. 7 is a top plan view of the outside corner post of FIG. 6.
Figure 9:
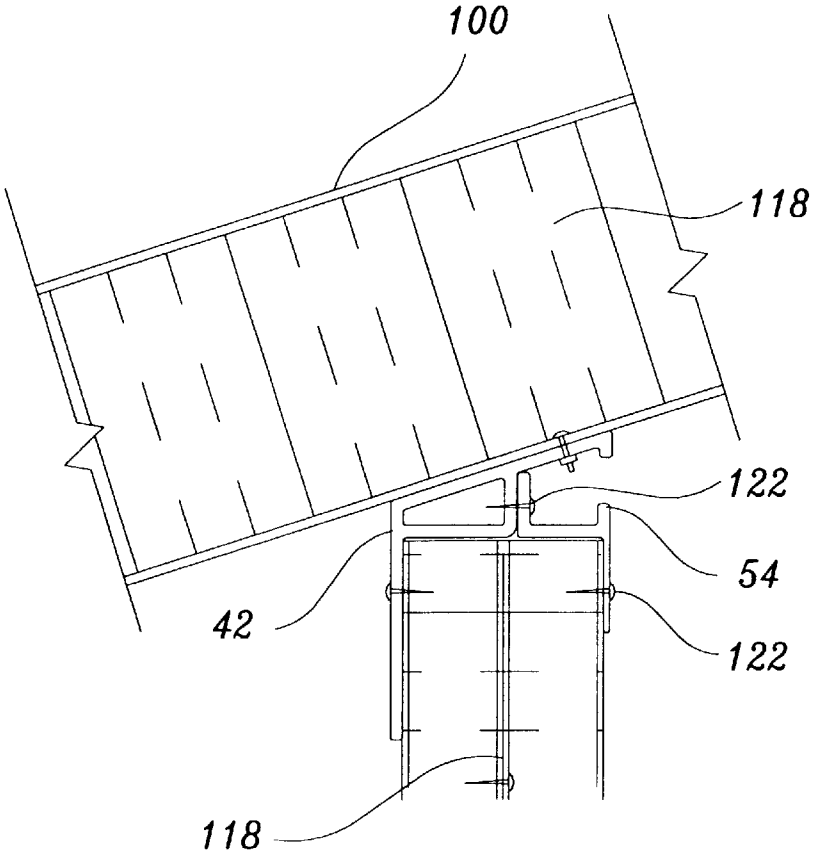
FIG. 9 is a right side plan view of the assembly of FIG. 8.
Figure 11:
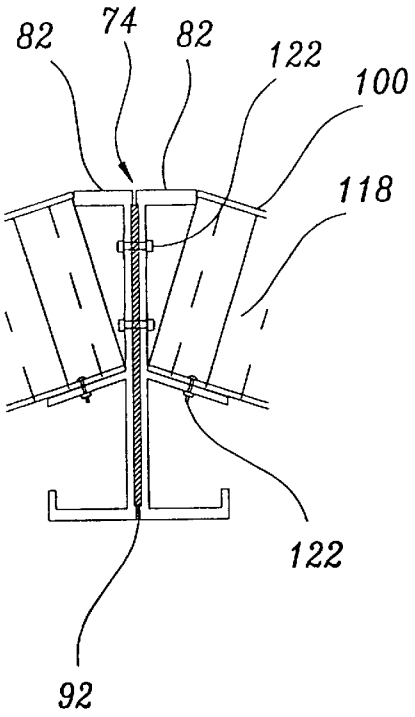
FIG. 11 is a right side plan view of the ridge beam portion of the assembly of FIG. 10.
Figure 10:
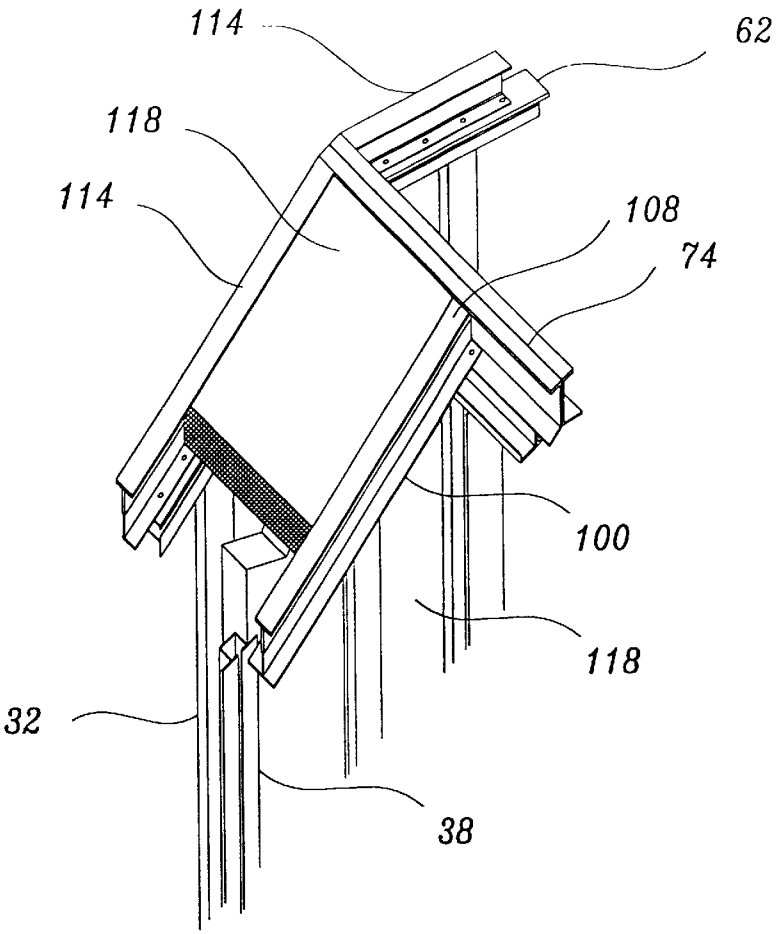
FIG. 10 is a perspective view an alternative embodiment ridge beam assembled with the rafters in place.
Figure 13:
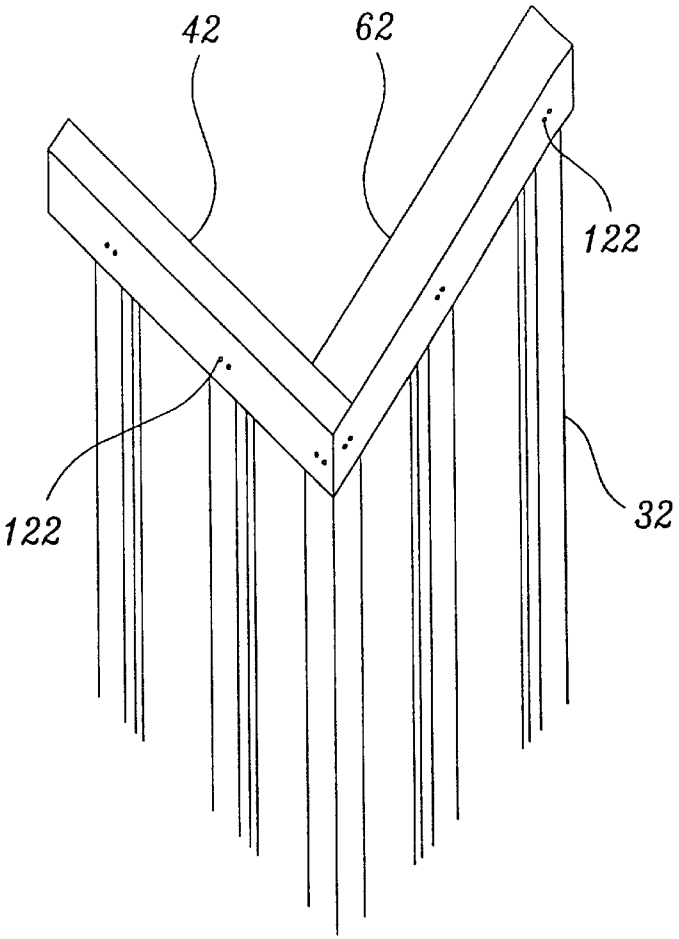
FIG. 13 is a perspective view of the eave header, gable header and outside stud assembly in a preferred embodiment.
Figure 12:
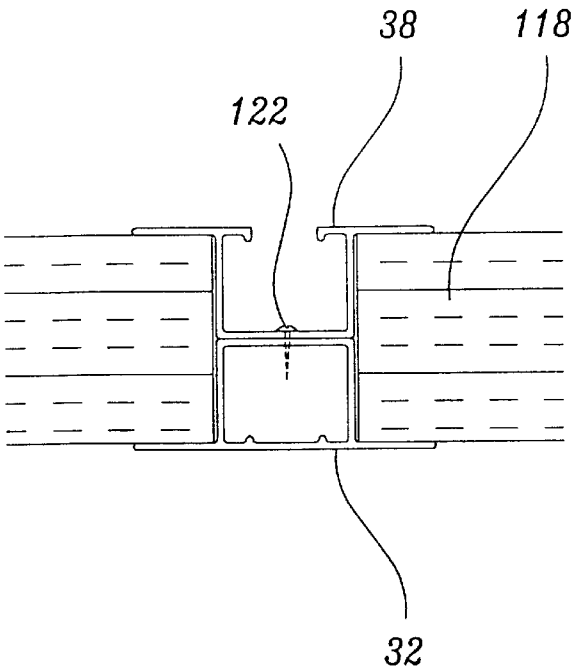
FIG. 12 is a top side plan view of the inside and outside stud assembly in a preferred embodiment.
Figure 14:
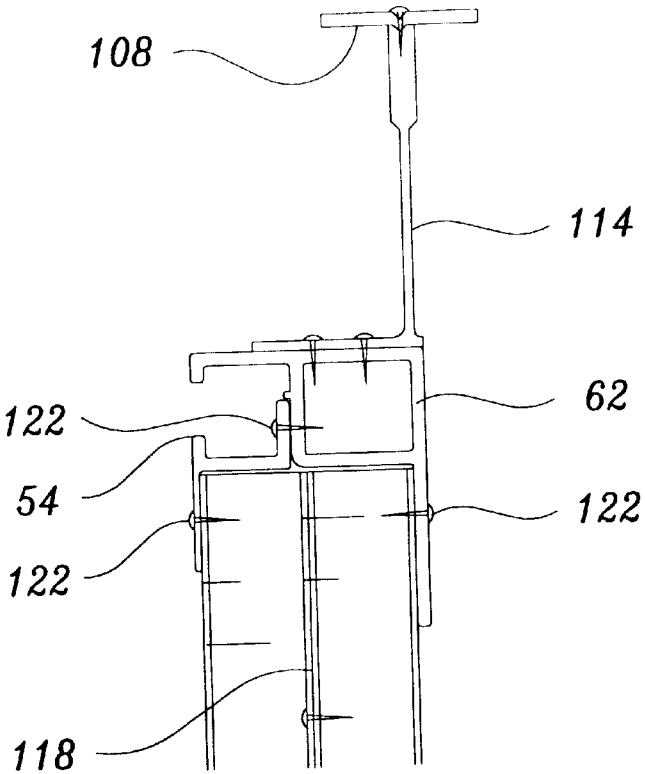
FIG. 14 is a right side plan view of the gable header and end rafter mounted onto an outside stud in a preferred embodiment.
Figure 15:
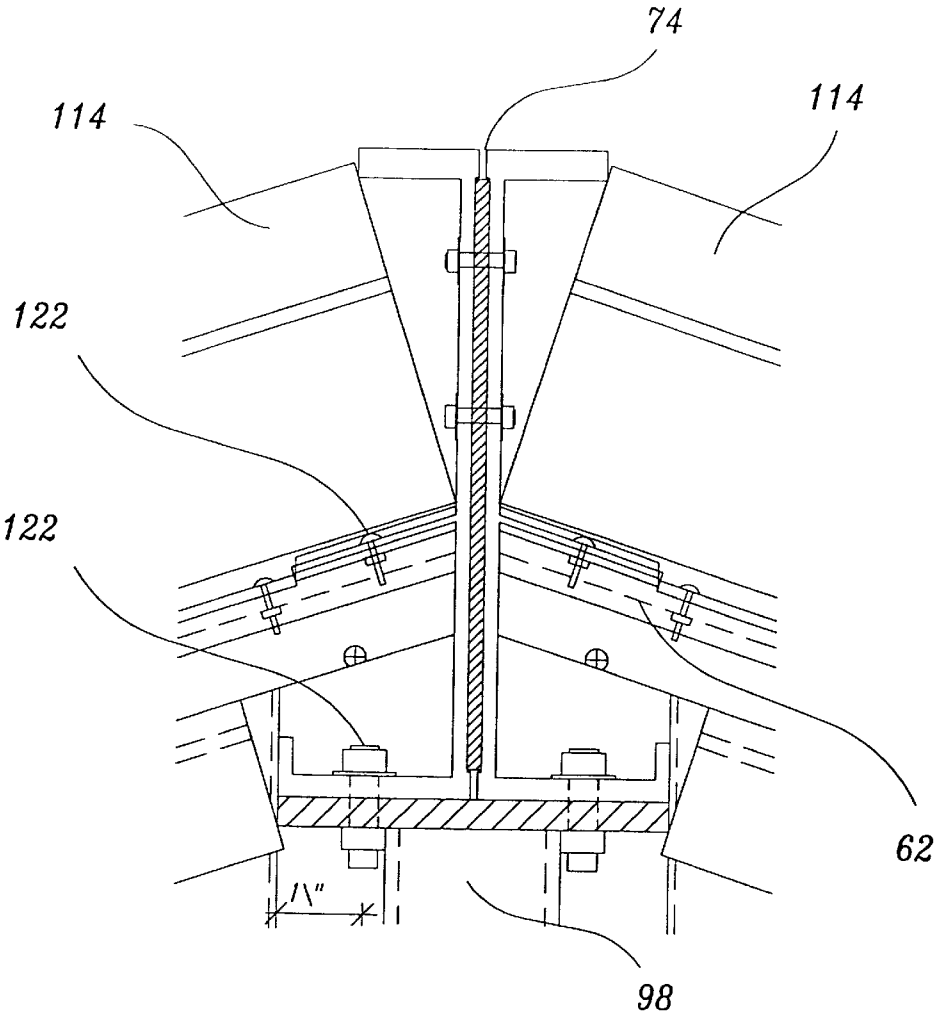
FIG. 15 is a plan view of the alternative embodiment ridge beam assembled with end rafters in place and an alternative embodiment steel column support of the gable end.
Figure 16:
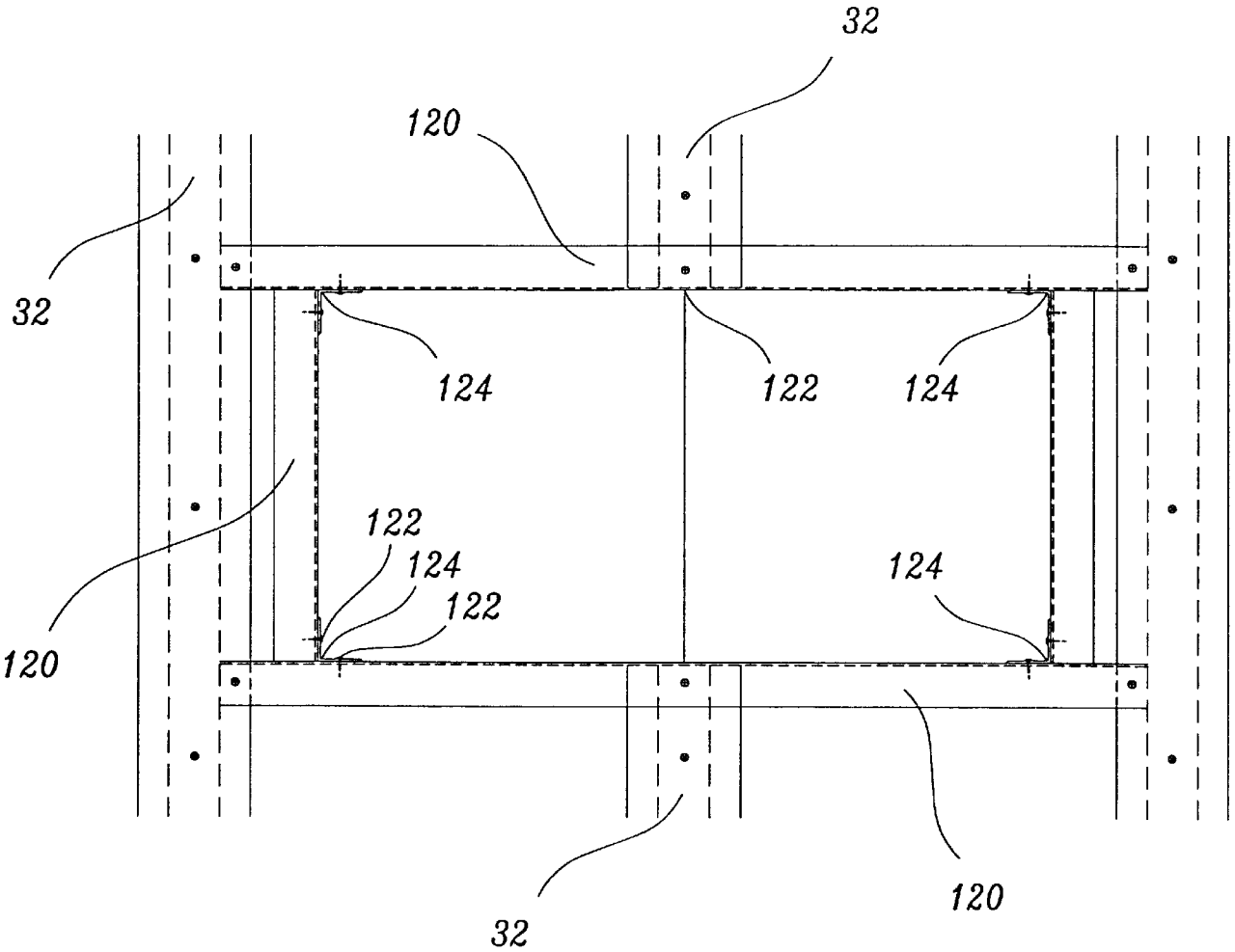
FIG. 16 is a front plan view of a window opening showing the use of window and door channels in a preferred embodiment.
Figure 17:
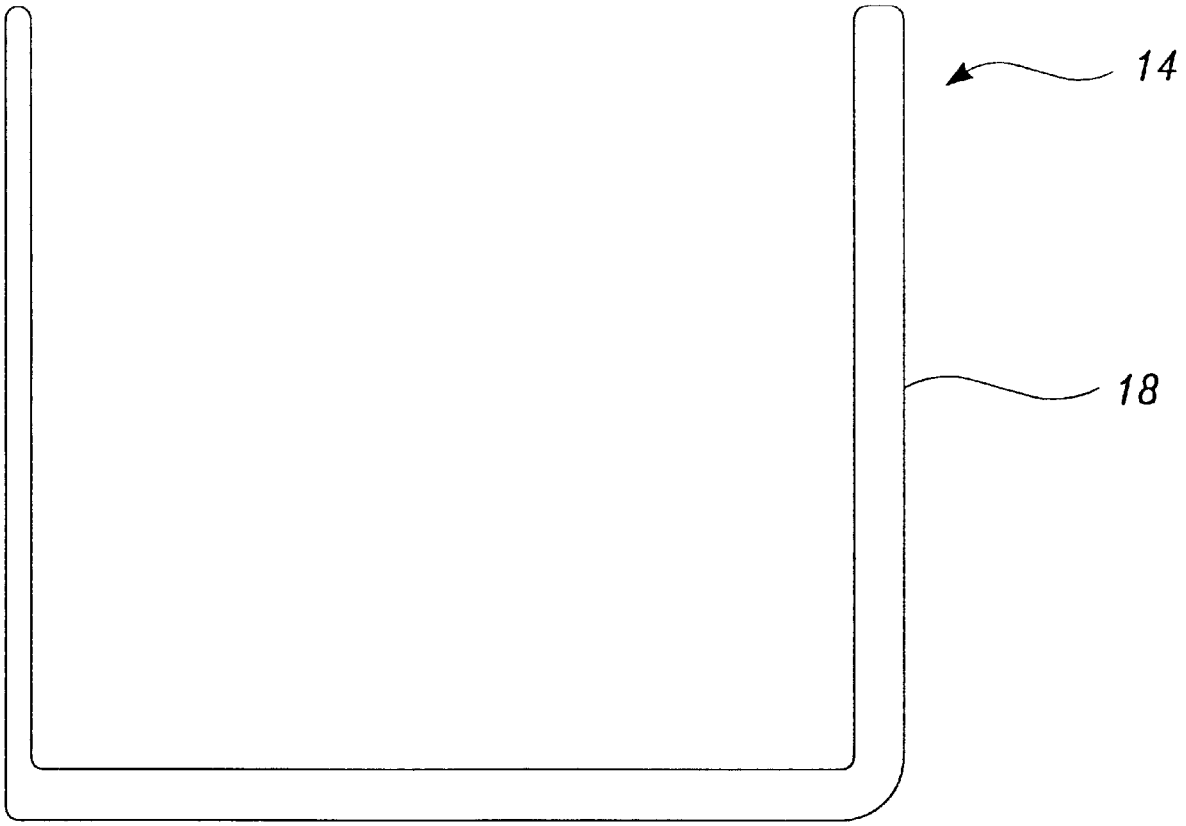
FIG. 17 is a cross sectional view of an alternative embodiment of a sill plate.
Figure 18:
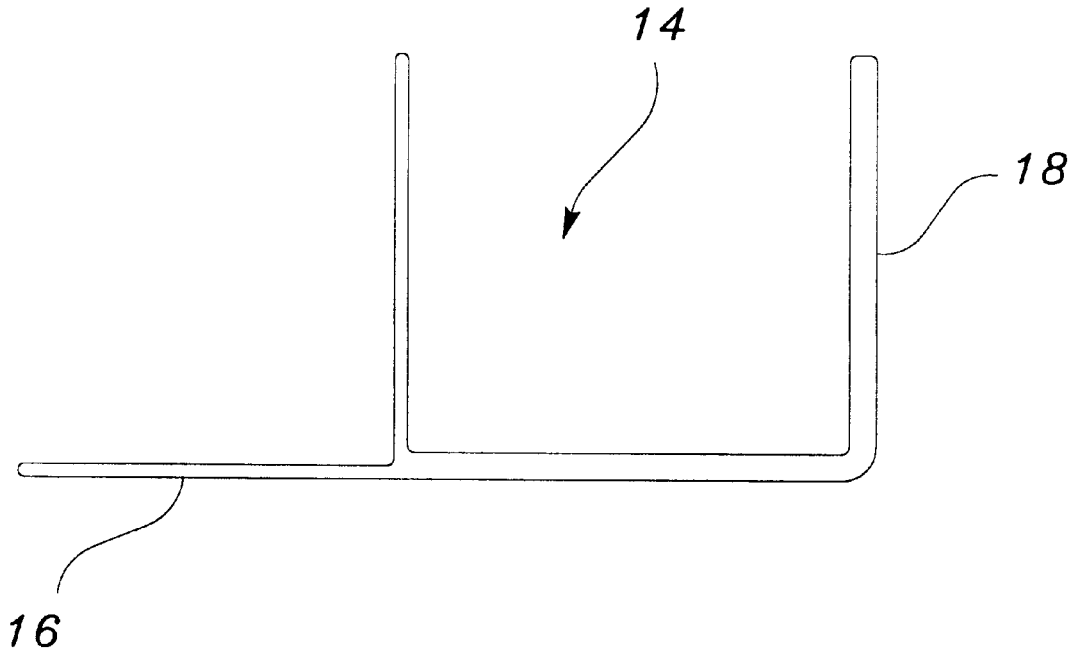
FIG. 18 is a cross sectional view of a preferred embodiment of a sill plate.
Figure 19:
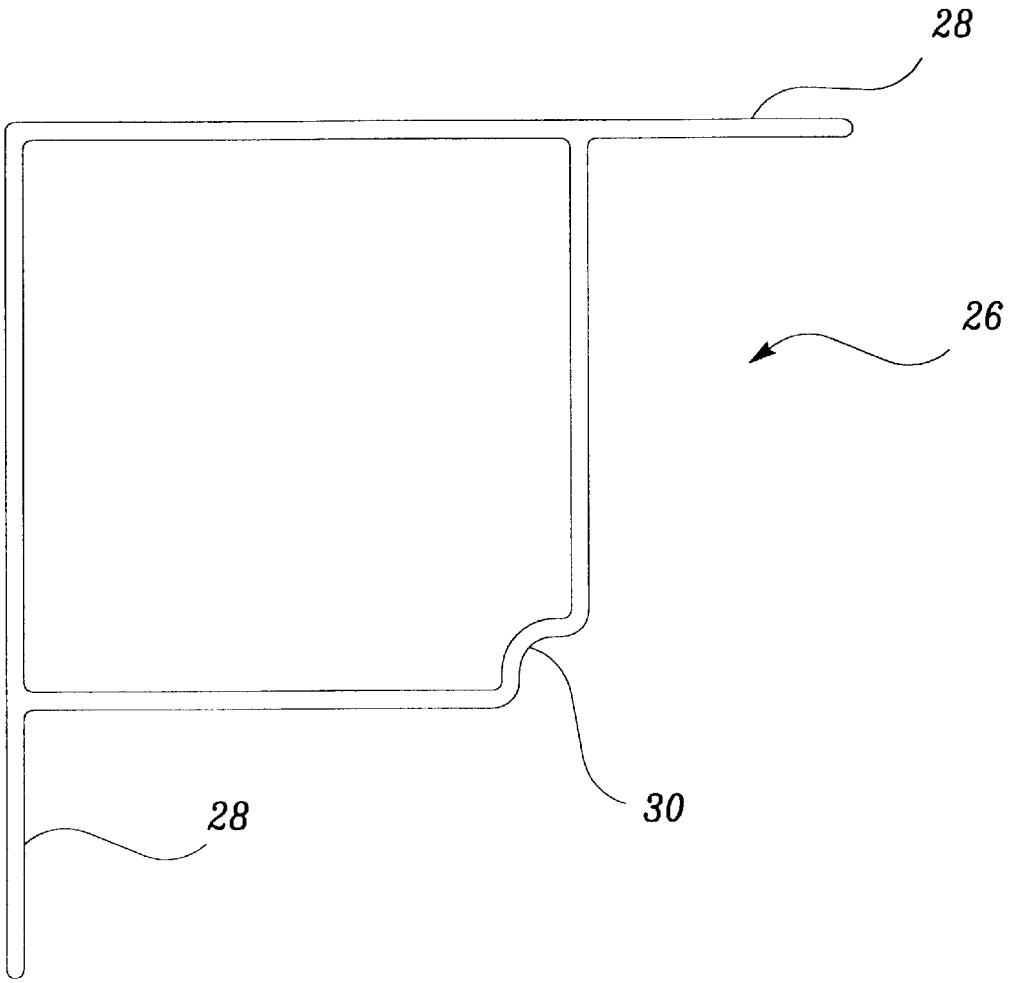
FIG. 19 is a cross sectional view of a preferred embodiment of an outside corner post.
Figure 21:
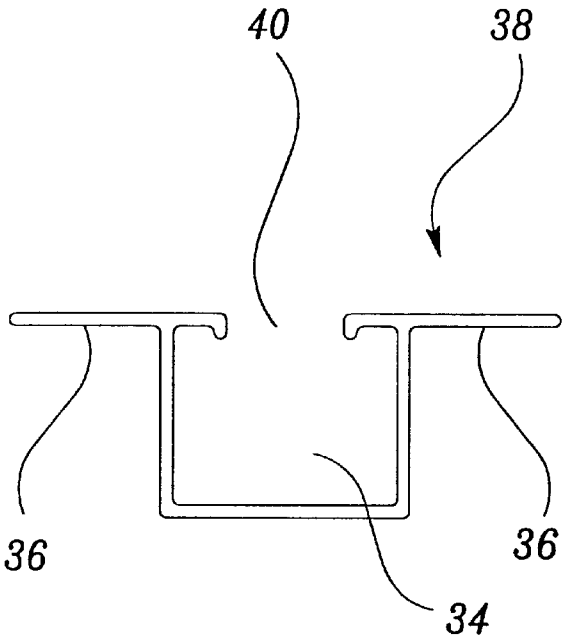
FIG. 21 is a cross sectional view of a preferred embodiment of an inside stud.
Figure 20:
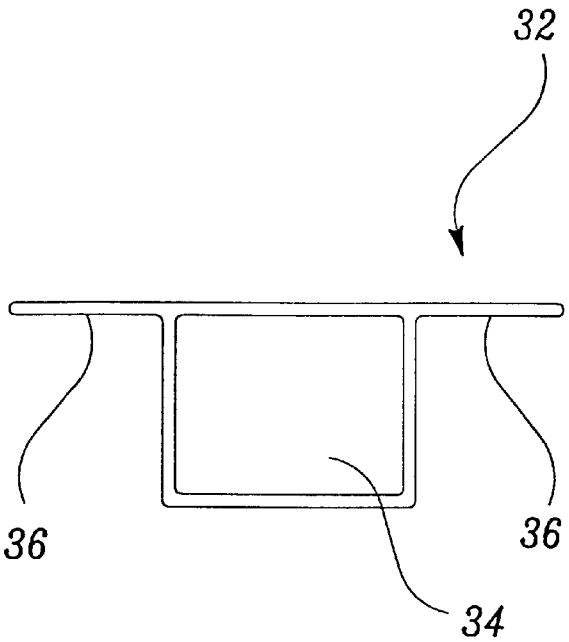
FIG. 20 is a cross sectional view of a preferred embodiment of an outside stud.
Figure 23:
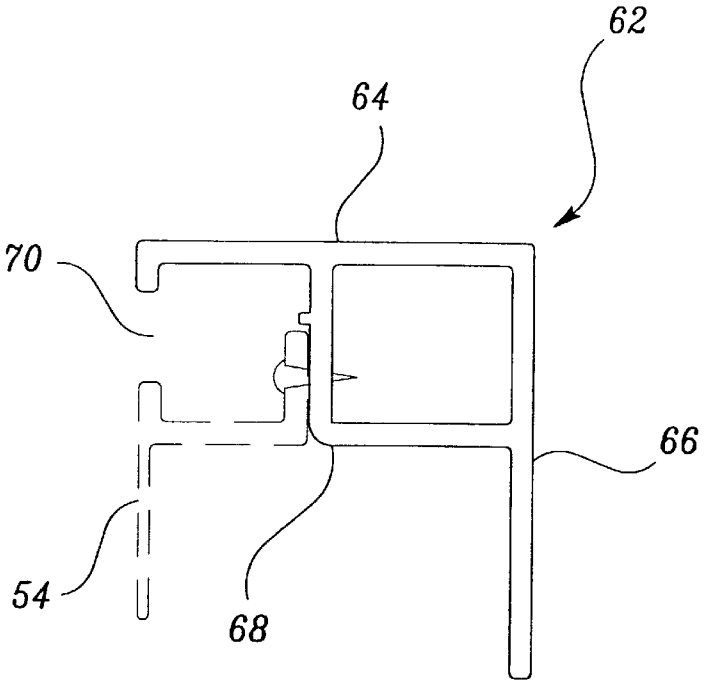
FIG. 23 is a cross sectional view of a preferred embodiment of a gable header, showing an inside attachment clip in phantom.
Figure 22:
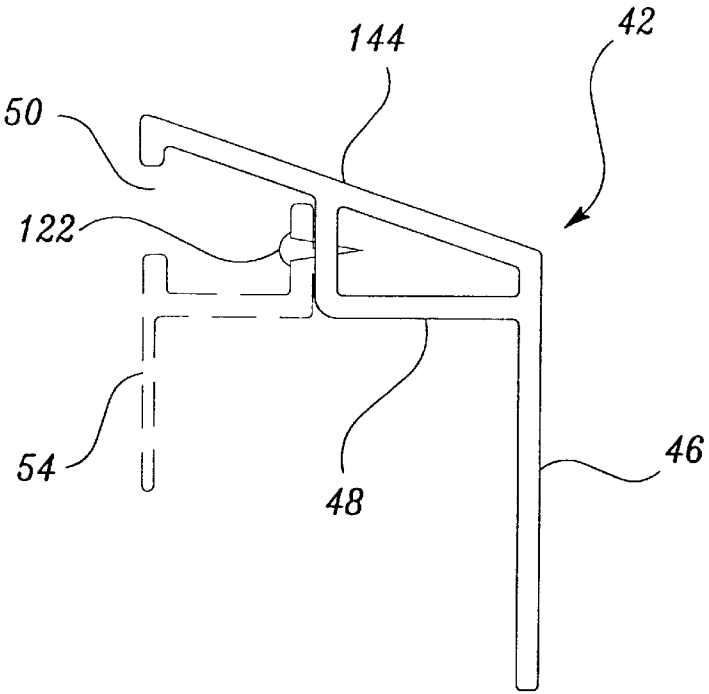
FIG. 22 is a cross sectional view of a preferred embodiment of an eave header, showing an inside attachment clip in phantom.
Figure 26:
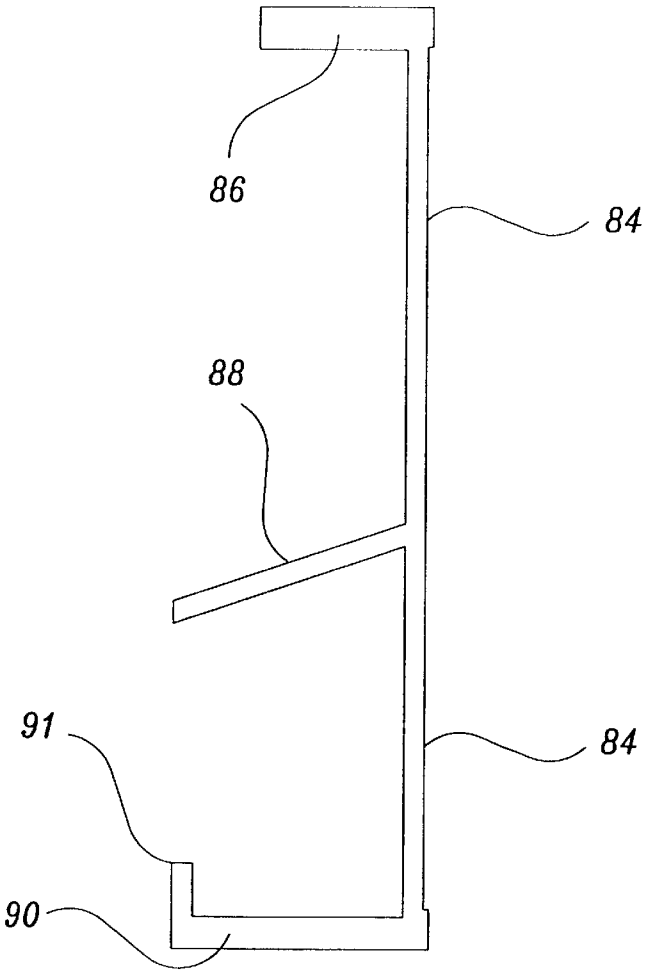
FIG. 26 is a cross sectional view of a fastener joined section of a ridge beam of an alternative embodiment.
Figure 24:
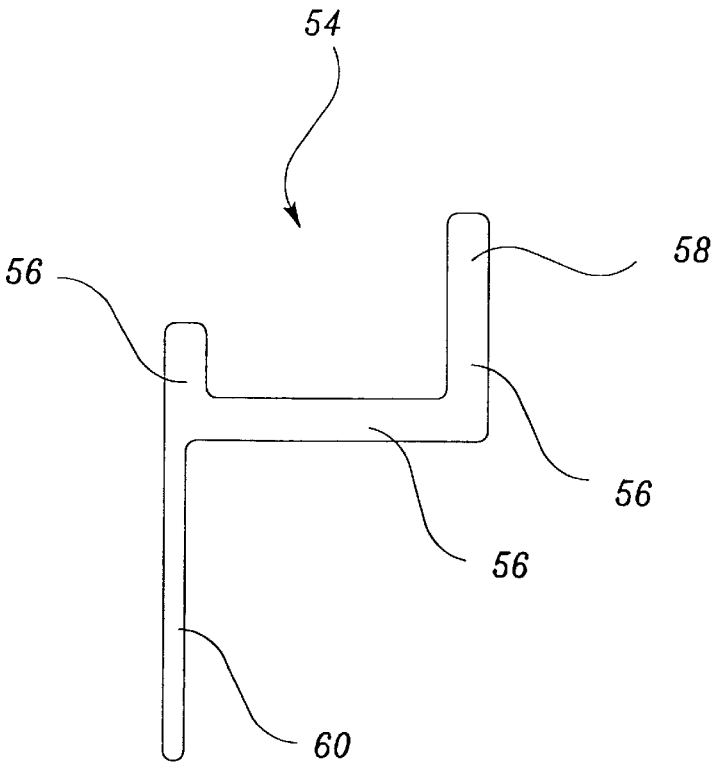
FIG. 24 is a cross sectional view of a preferred embodiment of an inside attachment clip.
Figure 25:
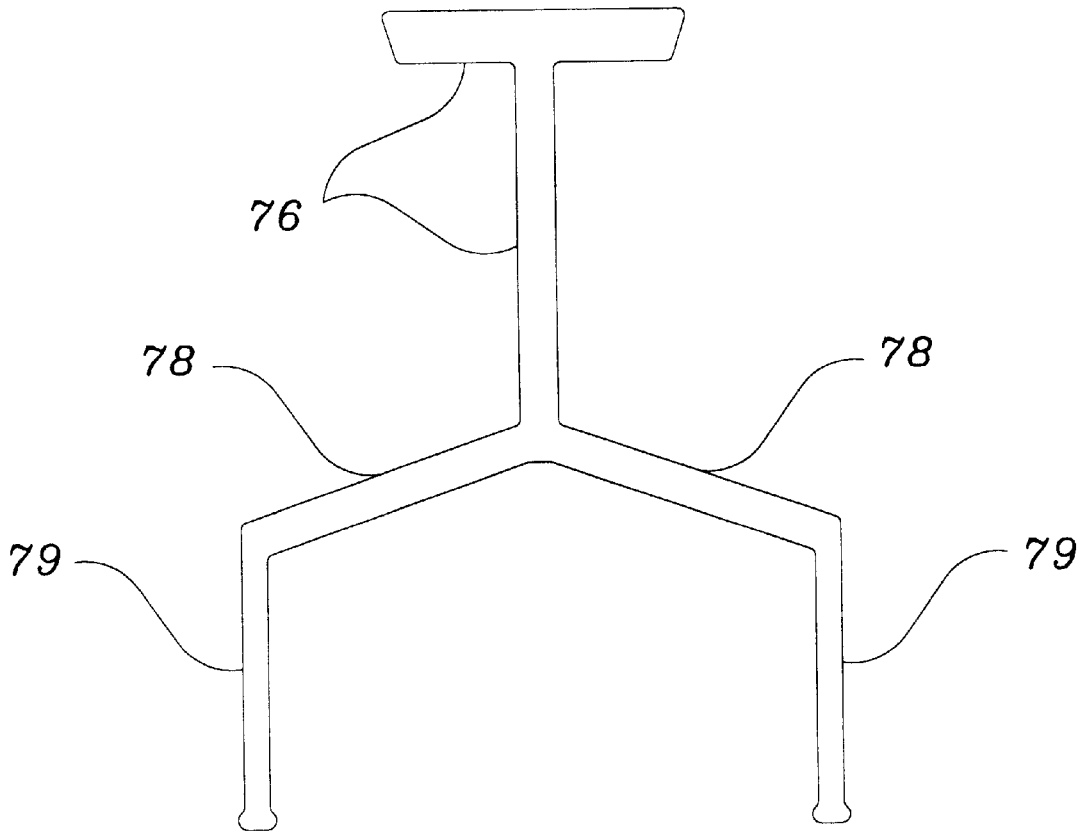
FIG. 25 is a cross sectional view of a preferred embodiment of a ridge beam.
Figure 28:
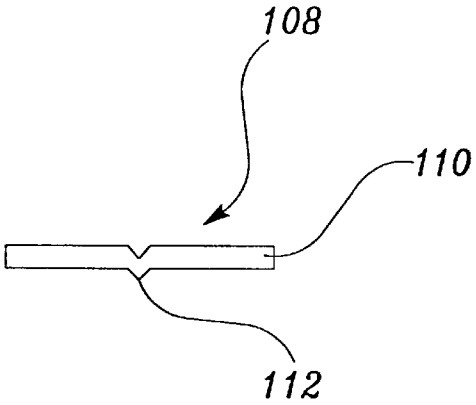
FIG. 28 is a cross sectional view of a preferred embodiment of a rafter clip.
Figure 27:
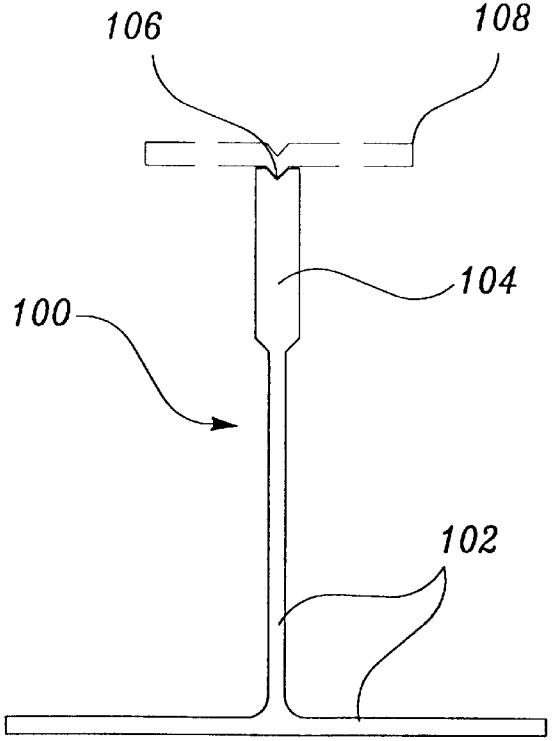
FIG. 27 is a cross sectional view of a preferred embodiment of a roof rafter showing a rafter clip in phantom.
Figure 30:
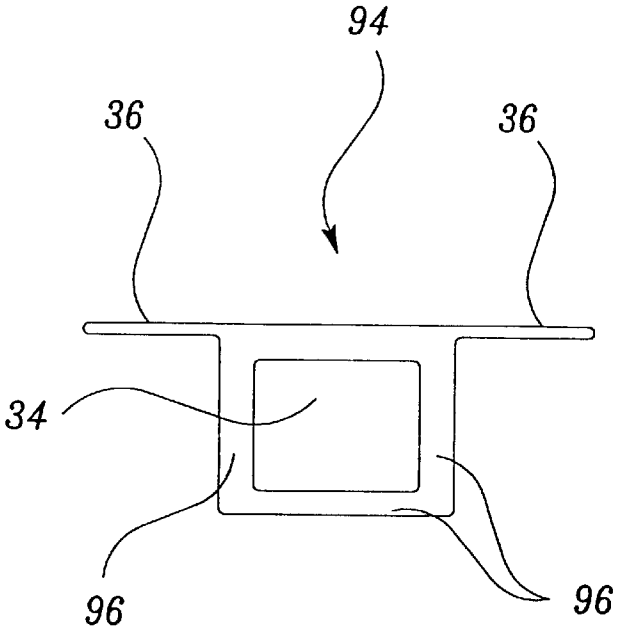
FIG. 30 is a cross sectional view of a preferred embodiment of a structural column stud.
Figure 29:
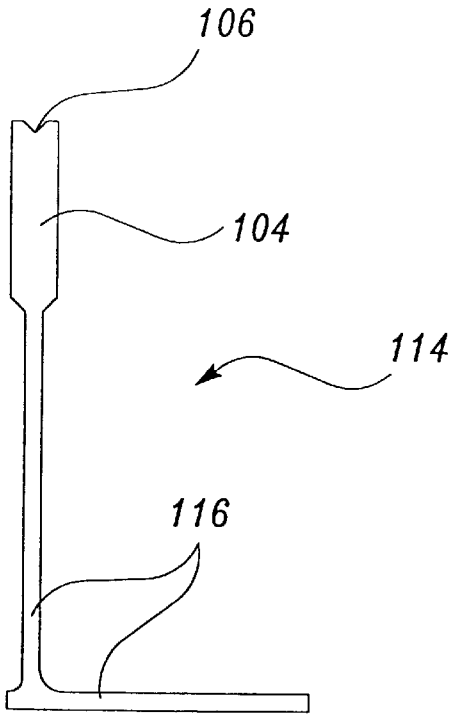
FIG. 29 is a cross sectional view of a preferred embodiment of an end rafter.
Figure 31:
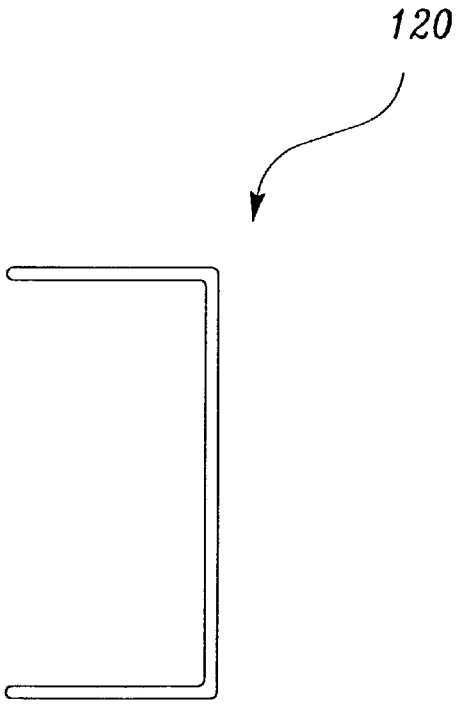
FIG. 31 is a cross sectional view of a preferred embodiment of a window and door channel.

Upon the installation of the eave headers 42 and gable headers 62 a ridge beam 74 is placed and attached between the two opposing sides of the substantially rectangular form 20 containing the gable headers 62. In a preferred embodiment as shown in FIG. 25, the ridge beam 74 is comprised of a "T" -shaped member 76 having one or more rest plates 78 at the base of the "T". The rest plates 78 are positioned at an angle between 90 and 135 degrees relative to the base of the "T" where they are mounted. Onto the rest plates 78 and opposite the base of the mounting point is placed one or more plate ears 79 which are mounted substantially inline with the "T"-shaped member 76. Alternative embodiments could have plate ears 79 with any angle relative to the "T"-shaped member 76 which the user desires.

In a preferred embodiment, placement of the ridge beam 74 is accomplished by the removal of the plate ears 79 only on that portion of the ridge beam 74 which rests upon the gable headers 62.

In a preferred embodiment, once the proper length of plate ears 79 are removed, the ridge beam 74 is positioned onto the gable headers 62 generally towards the center of the substantially rectangular form 20. Alternative embodiments may position the ridge beam 74 onto any portion of the gable headers 42 which is desired by the user. Upon positioning, the ridge beam 74 is secured to the gable headers 42 with fasteners 122 wherever the user deems appropriate. In a preferred embodiment, a ridge beam cover, typically vinyl, is placed between the plate ears 79 opposite the rest plates 78 if the space between said ears 79 has not been previously encased by a covering material such as drywall. This allows the volume defined by the rest plates 78 and plate ears 79 to serve as an area for utility runs. Again, in a preferred embodiment, each ridge beam 74 is formed as a single beam from pultruded fiberglass.

In some applications, a longer and stiffer ridge beam may be desirable. An alternative embodiment of the ridge beam 74 would be useful in this type of application. An alternative ridge beam 74 is comprised of two fastener joined sections 82 between which is sandwiched a flitch plate 92. The flitch plate 92 is typically manufactured of steel although other structural materials such as aluminum alloy, composites, wood or plastic may be used for the flitch plate 92 as required for the application. The cross section of the fastener joined section 82 is comprised of a first vertical plate 84 onto which is formed a top plate 86. In a preferred form, the top plate 86 generally forms a right angle with the first vertical plate 84. Alternative forms could place the top plate 86 at any angle which is necessary for the application.

Onto the first vertical plate 84 and opposite the top plate 86 is formed a bottom channel plate 90 having a bottom channel ear 91 in a preferred form. The bottom channel plate 90 is generally positioned in a 90 degree relation to the first vertical plate 84 in a preferred form. Alternative forms may have any angle which is most desirable for the application. Between the top plate 86 and the bottom channel plate 90 is formed a rest plate 88. The rest plate 88 typically forms a minor angle with the first vertical plate 84 between 40 and 90 degrees, depending on the desired pitch of the roof of the structural framing system 10.

The alternative embodiment of the ridge beam 74 which contains the flitch plate 92 is typically placed and fastener mounted onto steel columns 98 at the gable ends of the structural framing system 10, although column studs 94 may also be used. The bottom channel plate 90 of the alternative embodiment of the ridge beam 74 is typically placed onto the steel columns 98 and secured with fasteners 122. The ridge beam 74 position is generally towards the center of the substantially rectangular form 20. Further alternative embodiments may position the alternative ridge beam 74 onto any portion of the gable end which is required by the application.

Support is provided on the ends of the ridge beam 74 by column studs 94 or steel columns 98. The column studs 74 replace the outside studs 32 under the gable header 62 where the ridge beam 74 is located. Each column stud 74 has substantially the same outside cross section as the outside stud 32 with the exception that the substantially rectangular and hollow cross section 34 has a thickened rectangular wall 96. In a preferred embodiment, each column stud 74 is formed as a single stud from pultruded fiberglass. If further support is required for the ridge beam 74, one or more column studs 94 or steel columns 98 are located under the ridge beam 74 at various points within the structural framing system 10. In an alternative embodiment, especially where building codes or strength requirements dictate, steel columns 98 are used to support the ridge beam as an alternative to the column studs 94. When steel columns 98 are used, typically channels 120 are positioned and secured next to the steel column 98. This provides a secure interface of the gable headers 62 with the intersection point of the steel column 98, ridge beam 74 and gable headers 62.

Upon installation of the ridge beam 74 and its supporting columns 98 or studs 94, a plurality of rafters 100 are placed and attached between the ridge beam 74 and the eave headers 42. Each rafter 100 rests upon the first eave plate 44 and the rest plate, 78 or 88, of the ridge beam 74. Again, each rafter is secured with fasteners 122 to the ridge beam 74 and the eave header 42. In a preferred embodiment, each rafter 100 is separated by 24 inches, center to center, but may be separated by any width required by the application.

In a preferred embodiment, the rafter 100 cross section is formed as a substantially inverted "T" shaped form 102 with an attaching rafter clip 108 located at the topmost portion of the inverted "T". The substantially inverted "T" shaped form 102 contains a thickened top boss portion 104 which allows for fasteners 122 to be placed into it for securing of the rafter clips 108. Further securing of the rafter clip 108 is provided by a lengthwise notch 106 on the thickened top boss portion 104 of the rafter 100. In a preferred embodiment, each rafter 100 is formed as a single rafter from pultruded fiberglass.

Each rafter clip 108 is formed as a substantially flat plate 110 with a center rib 112. The center rib 112 fits integrally with the lengthwise notch 106 of the rafter 100 to help secure the rafter clip 108 to the rafter 100. In a preferred embodiment, each rafter clip 108 is formed as a single pultruded fiberglass plate.

Before the rafter clip 108 is secured to the rafter 100, a roofing panel or insulation 118 is typically placed into the area formed by the ears of the "T" 102 and the rafter clip 108. Once fastened, the rafter clip 108 helps to hold and secure the roofing panel or insulation 118 in place.

At each gable end of the structural framing system 10, an end rafter 114 is used in place of the rafter 100 and fits between the ridge beam 74 and the eave header 42 as a typical rafter 100. The end rafter 114 has substantially the same cross section as the rafter 100 with the exception of its cross section having a substantially "L" shaped form 116. The ear of the "L" shape 116 is placed toward the internal portion 22 of the substantially rectangular form 20 when installed and functions the same as the "T" 102 of the rafter 100. Use of this end rafter 114 prevents unwanted overhang near the external portion 24 of the substantially rectangular form 20 at the gable ends and also brings outside closure to the edge of the structure within the rafter plane. Again, in a preferred embodiment, each end rafter 114 is formed as a single pultruded fiberglass rafter. A rafter clip 108 is placed onto each end rafter 114 in the same manner as with the rafters 100 in order to sandwich and hold roofing panels and/or insulation material 118.

An alternative embodiment would replace the structure defined by the ridge beam 74, the rafters 100, and the end rafters 114 with a plurality of roof trusses 126. Each roof truss 126 rests upon opposing eave headers 42 and spans the entire width of the structure. Each roof truss 126 is secured to the eave header 42 by means of a truss clip 130 which is secured to each member by means of fasteners 122. The roof truss 126 is of conventional design and preferably formed from plurality of rectangular pultruded members having a hollow cross section 128 and connected with fasteners and/or plates. The exact angular placement of the rectangular members 128 within the truss 126 form can vary substantially in a conventional truss design as described here.

Should the user desire window or door framing, a plurality of window and door channels 120 are provided. Each window and door channel 120 is of substantially "C" shaped cross section and in a preferred embodiment formed as a single pultruded fiberglass channel. Each channel 120 is mounted vertically and/or horizontally where necessary to form a generally rectangular frame and is cut to the required length when placed. The channels 120 function much as conventional framing lumber with the exception that they offer all of the advantages of pultruded fiberglass in a referred embodiment. An angle 124 is typically placed at the intersection of each channel 120 and secured with fasteners 122 in order to secure each channel 120.

Although the preferred embodiments of the structural framing system described herein would utilize a pultruded fiberglass material, the structural framing system of the present art may be manufactured of a variety of materials, including but not limited to wood, plastic, steel, aluminum, or other composite materials. The preferred and alternative embodiments described herein may also be manufactured in different sizes and colors.

All of the aforementioned structural components are fastened together in their respective locations with the use of conventional fasteners 122 such as sheet metal screws, machine screws, nuts, and concrete anchor bolts, but may also be fastened using other types fasteners such as pins, studs or clamps or with the use of specialty adhesives. In a preferred embodiment, the fasteners are comprised of #10 sheet metal screws except for fastening of the column studs, ridge beam, flitch plate and associated beam, end rafters, and roof rafters which use ¼-20 machine screws for fastening.

Upon assembly of the structural framing system 10, the external 24 and the internal 24 portions may be finished as the user desires. That is, if exterior siding is desired, it may be attached to the outside studs 32 as in conventional framing systems. If interior drywall is desired, it may also be attached to the inside studs 38 as in conventional framing systems. Again typically fasteners 122 are used for the attachment. Provisions have been made and described herein for utility runs such as electric and water.

From the foregoing description those skilled in the art will appreciate that all objects of the present invention are realized. An structural framing system and method of assembly been shown and described which permits a user to provide a strong, and weather and corrosion resistant, frame for a house, shed or shelter with a minimum of skilled labor or specialty tools. The art of this invention in its preferred pultruded form is able to withstand severe wind, temperature and corrosion conditions and yet provide a comfortable shelter. The present invention, in alternate embodiments with the unique cross sections described, provides for the use of materials other than pultruded fiberglass when the conditions require.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A structural framing system, comprised of:

a plurality of elongated members, said elongated members further described as, a plurality of sill plates arranged in a substantially rectangular form having an internal and external portion; and four or more outside corner posts placed onto and substantially perpendicular to said sill plates at corners of said rectangular form; and a plurality of outside studs placed and secured onto and substantially perpendicular to said sill plates near said external portion; and a plurality of inside studs placed and secured onto and substantially perpendicular to said sill plates near said internal portion and mated lengthwise with said outside stud; and two or more eave headers placed and secured onto said outside studs and said inside studs opposite said sill plate and on two opposing sides of said substantially rectangular form whereby said eave headers form an eave base; and two or more gable headers placed and secured onto said outside studs and said inside studs opposite said sill plate and onto those sides of said substantially rectangular form not having eave headers; and one or more ridge beams placed between the sides of said substantially rectangular form having said gable headers and attached thereto; and one or more columns placed at each end of said one or more ridge beams, whereby said columns provide support for said ridge beam; and a plurality of rafters placed and attached between said ridge beam and said eave headers.

2. The structural framing system as set forth in claim 1 whereby:

said sill plates, outside corner posts, outside studs, inside studs, eave headers, gable headers, ridge beams, columns, and rafters are manufactured of pultruded fiberglass material.

3. The structural framing system as set forth in claim 1 whereby:

said sill plate comprises a cross section of "U" shape; and said outside corner post comprises a substantially rectangular cross section with extension ears on a portion of the substantially rectangular cross section which abuts said sill plate and which is proximate said external portion; and said outside stud comprises a cross section which is substantially rectangular with coplanar and substantially flat ears on that portion of said outside studs substantially rectangular cross section which is proximate said external portion; and said inside stud comprises a cross section equivalent to said outside studs and further comprising a lengthwise slot between said substantially flat ears; and said eave header cross section comprises an integral first eave plate, a second eave plate and an eave plate support section, said first eave plate and said second eave plate integrally positioned between 90 and 135 degrees relative to each other and said eave plate support section positioned within an area formed between said first eave plate and said second eave plate, whereby said rafters are able to rest upon said first eave plate; and said gable header cross section comprises an integral first gable plate, a second gable plate and a gable plate support section, said first gable plate and said second gable plate integrally positioned approximately 90 degrees relative to each other and said gable plate support section positioned within an area formed between said first gable plate and said second gable plate; and said rafters cross section comprises an inverted "T" shaped form having a top side and bottom side.

4. The structural framing system as set forth in claim 3 whereby:

said sill plates, outside corner posts, outside studs, inside studs, eave headers, gable headers, ridge beams, columns, and rafters are manufactured from pultruded fiberglass material.

5. The structural framing system as set forth in claim 3 whereby:

said ridge beam cross section comprises a "T" shaped member having a base and a top, and having one or more rest plates attached upon said base of said "T", and further having one or more plate ears integrally attached to said rest plates, whereby said rafters are able to rest upon said rest plates.

6. The structural framing system as set forth in claim 3 whereby:

said ridge beam cross section comprises two fastener joined sections having a flitch plate sandwiched between said fastener joined sections;

said fastener joined section cross section having a first vertical plate with a top plate, and a bottom channel plate attached to said vertical plate opposite said top plate, and a rest plate attached between said top plate and said bottom channel plate, whereby said rafters are able to rest upon said rest plate.

7. The structural framing system as set forth in claim 3 whereby:

said column is comprised of a column stud having an outside cross section of substantially similar outside cross section as said outside stud.

8. The structural framing system as set forth in claim 3 whereby:

said column is comprised of a steel column.

9. The structural framing system as set forth in claim 1 further comprising:

one or more end rafters located proximately near said gable headers between said eave header and said ridge beam.

10. The structural framing system as set forth in claim 9 whereby:

said end rafter comprises a substantially "L" shaped cross sectional form.

11. The structural framing system as set forth in claim 3 whereby:

said eave headers and said gable headers are secured onto said outside studs and said inside studs with a plurality of inside attachment clips which attach to said eave headers and said gable headers.

12. The structural framing system as set forth in claim 11 whereby:

said inside attachment clip comprises a clip "U" shaped channel, having an open end and a closed end, and having an attachment lip and a contacting ear formed integrally with said "U" shaped channel such that said attachment lip extends above the open end of said "U" shaped channel and said contacting ear extends below the closed end of said "U" shaped channel, whereby affixation of the inside attachment clip to the eave header is achieved via placement of a fastener through said attachment lip and into said eave header or gable header; and whereby said eave headers and said gable headers are secured onto said outside studs and said inside studs via said contacting ear abutment against said inside stud and said second eave plate or second gable plate abutment against said outside stud when said fastener is placed.

13. The structural framing system as set forth in claim 3 further comprising:

a plurality of rafter clips having a substantially flat shape and attached to said top side of said rafters, whereby said rafter clips are capable of holding insulation or roofing panels against said rafters.

14. The structural framing system as set forth in claim 3 further comprising:

a plurality of window and door channels of substantially "C" shape and formed into a substantially rectangular frame, whereby said frame may accept a door or window.

15. The structural framing system as set forth in claim 14 whereby:

said sill plates, outside corner posts, outside studs, inside studs, eave headers, gable headers, ridge beams, columns, rafters, and window and door channels are manufactured from pultruded fiberglass material.

16. The structural framing system as set forth in claim 3 said sill plate cross section further comprising:

an extension plate extending from said "U" shape, whereby said extension plate provides additional support for said sill plate.

17. A structural framing system, comprised of:

a plurality of elongated members, said elongated members further described as, a plurality of sill plates arranged in a substantially rectangular form having an internal and external portion; and four or more outside corner posts placed onto and substantially perpendicular to said sill plates at corners of said rectangular form; and a plurality of outside studs placed and secured onto and substantially perpendicular to said sill plates near said external portion; and a plurality of inside studs placed and secured onto and substantially perpendicular to said sill plates near said internal portion and mated lengthwise with said outside stud; and two or more eave headers placed and secured onto said outside studs and said inside studs opposite said sill plate and on two opposing sides of said substantially rectangular form whereby said eave headers form an eave base; and two or more gable headers placed and secured onto said outside studs and said inside studs opposite said sill plate and onto those sides of said substantially rectangular form not having eave headers; and a plurality of roof trusses of conventional design placed and secured upon said eave headers on each of said two opposing sides; and said roof trusses formed from a plurality of substantially rectangular members having a hollow core.

18. The structural framing system as set forth in claim 17 whereby:

said sill plates, outside corner posts, outside studs, inside studs, eave headers, gable headers, and said substantially rectangular members of said roof trusses are manufactured of pultruded fiberglass material.

* * * * *